United States Patent [19]

Makela

[11] 4,095,492

[45] Jun. 20, 1978

[54] RADIATOR CAP TURNING TOOL

[75] Inventor: Martin A. Makela, Waconia, Minn.

[73] Assignee: J-Mark Quality Products, Inc., Minneapolis, Minn.

[21] Appl. No.: 776,608

[22] Filed: Mar. 11, 1977

[51] Int. Cl.[2] ..... B67B 7/00

[52] U.S. Cl. ..... 81/3.43; 81/90 C

[58] Field of Search ..... 81/3.4, 3.43, 3.46 R, 81/3.47, 90 B, 90 C, 64

[56] References Cited

U.S. PATENT DOCUMENTS

| | | | |
|---|---|---|---|
| 2,656,749 | 10/1953 | Johnson | 81/64 |
| 3,261,242 | 7/1966 | Peters | 81/90 B |
| 3,731,560 | 5/1973 | Bares | 81/90 C |
| 3,785,225 | 1/1974 | McKenna et al. | 81/3.1 R |

FOREIGN PATENT DOCUMENTS

| | | | |
|---|---|---|---|
| 1,201,663 | 8/1970 | United Kingdom | 81/64 |

OTHER PUBLICATIONS

Armstrong Brothers Tool Co. Catalog, p. 33, "Crank Handles", Balance Handles.

*Primary Examiner*—James L. Jones, Jr.
*Assistant Examiner*—James G. Smith
*Attorney, Agent, or Firm*—H. Dale Palmatier

[57] ABSTRACT

A radiator cap gripping and turning tool having a stiff and flexible steel band formed in a loop, the ends of which are pivoted to a bar shaped link, upon which a handle is carried, the handle being swingable with the link over the top edge of the flexible band and into confronting relation with the top surface of the cap, thus permitting the application of downward pressure and turning simultaneously; the handle being swingable in the opposite direction to again cause the band to grip the cap and turn the cap in the opposite direction.

10 Claims, 6 Drawing Figures

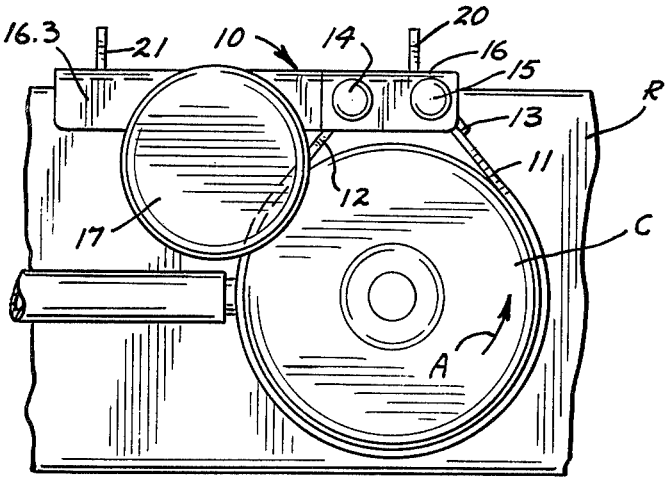
FIG. 1
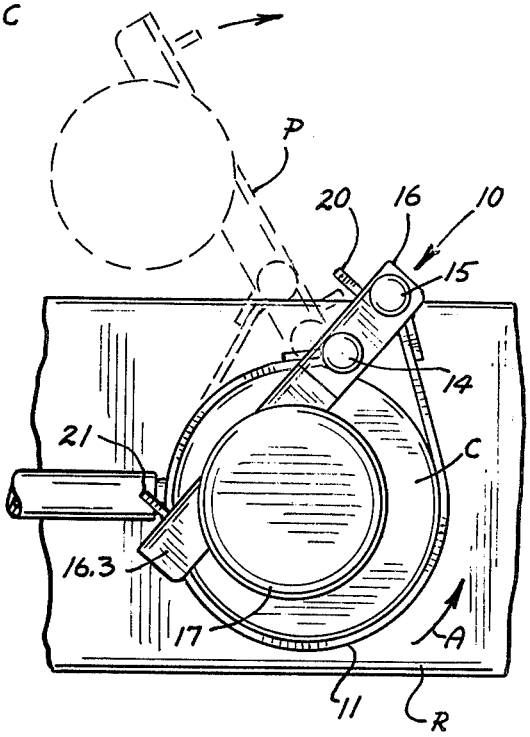
FIG. 3
FIG. 4
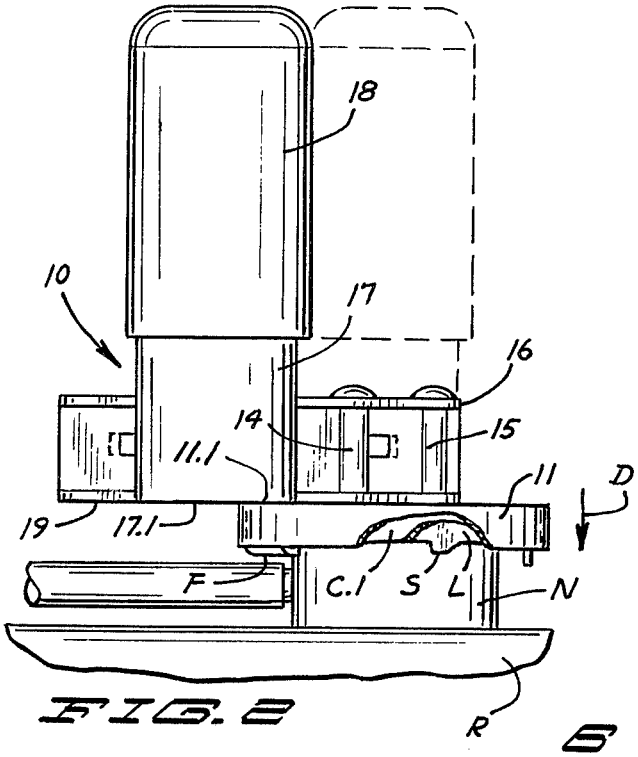
FIG. 2
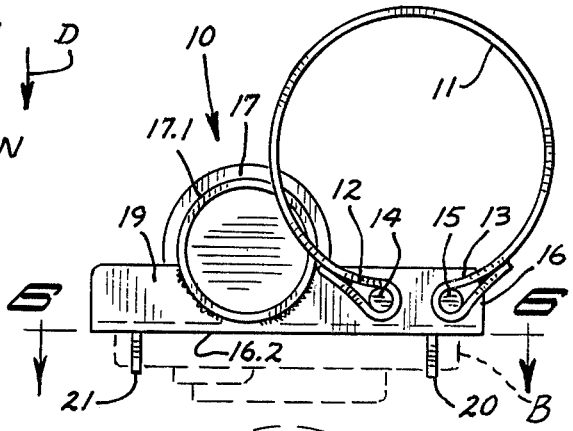
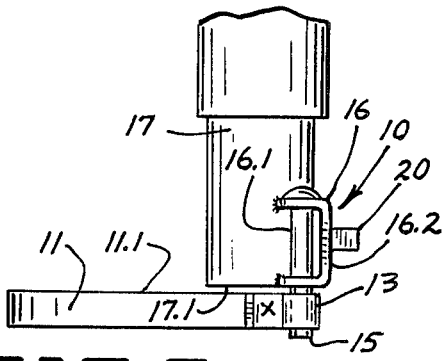
FIG. 5
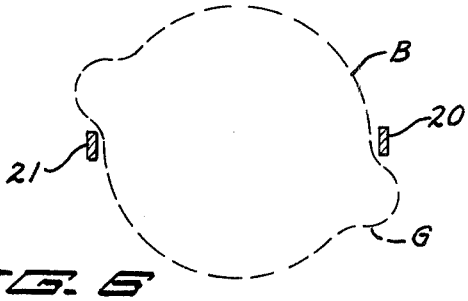
FIG. 6

RADIATOR CAP TURNING TOOL

This invention relates to a tool for loosening and tightening radiator caps in automotive type vehicles.

BACKGROUND OF THE INVENTION

In modern automobiles, radiators are designed so that access into the radiators becomes quite difficult, and intentionally so. In the ordinary operating and maintenance of an automobile, it is intended that the radiator shall remain sealed, and that if liquid needs to be added to the radiator, it is added by applying liquid into an overflow container. The radiator is designed to operate under a positive pressure of 10 to 20 psi over atmospheric, and the radiator and cooling system is intended to be tightly sealed most of the time.

As a result, the radiator caps are designed so that they are difficult to turn, and furthermore, during turning of the radiator cap to obtain access into the interior of the radiator, the cap must be depressed with downward pressure against a spring of substantial strength. Of course, all of this is a safety precaution so that the radiator cap will not be accidentally or casually removed for there is considerable danger in suddenly opening or removing the cap from a hot radiator, due to flying water particles and steam. Whereas radiator caps previously had radially extending lugs which could be gripped easily, most radiator caps nowadays are perfectly round.

Oftentimes access to a radiator cap is limited by other parts and accessories closely adjacent.

SUMMARY OF THE INVENTION

The present invention comprises a tool for ready and easy application to the radiator cap to facilitate turning the cap while downward pressure is applied directly to the cap so that the cap will clear stops on the neck of the radiator which normally prevent turning of the radiator cap. The tool is capable of operating in extremely cramped circumstances so as to avoid other obstructions adjacent the radiator cap.

The tool also facilitates turning of the radiator cap when applying the cap onto the neck of the radiator for again sealing the radiator.

Provision is made for turning both truly round radiator caps and for turning radiator caps with radially projecting lugs.

BRIEF DESCRIPTION OF DRAWINGS

FIG. 1 is a top plan view of the tool as it is initially applied to a radiator cap.

FIG. 2 is an elevation view of the tool, partly broken away for clarity of detail.

FIG. 3 is a top plan view, illustrating two shifted positions of the tool.

FIG. 4 is a bottom plan view of the tool.

FIG. 5 is an end elevation view of the tool.

FIG. 6 is a detail section view taken approximately at 6—6 in FIG. 4 and illustrating the manner of usage with a radiator cap with radially protruding lugs.

DETAILED SPECIFICATION

One form of the present invention is shown in the drawings and is described herein. The radiator cap gripping and turning tool is indicated in general by numeral 10 and includes a stiff but resiliently flexible band 11 which may be formed of any of a number of materials, but is most desirably formed of a high carbon steel. The band 11 is normally bent to form a generally circular loop, and the opposite ends 12 and 13 are positioned adjacent each other and are formed with bights permanently formed in such ends. The band 11 has a length so that it will extend around the entire periphery of a cap C for an automotive type radiator R; and the band 11 has a width so that it will lie in flush engagement with and substantially across the entire width of the peripheral wall C.1 of the cap C. It will be recognized that radiator caps as currently constructed are fitted to closely embrace a downturned lip L of the neck N of the radiator R and that a depending lug or stop S is provided on the lower edge of the lip L on the radiator neck to cooperate with a flange F at the lower edge of the sidewall C.1 of the cap C so as to normally prevent turning of the cap C in a counterclockwise direction as indicated by arrow A as a safety measure. It is required, in order to complete the turning of the cap C in a counterclockwise direction for purpose of removing the cap from the radiator neck N, that the cap C be depressed in a downward direction as indicated by the arrow D so that the flange F will be able to clear the stop S and pass by it as the cap is turned in a counterclockwise direction. After further turning a few degrees in a counterclockwise direction, the cap C may be lifted off the neck N to provide access into the radiator R.

When the cap C is to be returned onto the neck and sealed, it will be turned in a clockwise direction and the flange F will ride over the camming ramp on the stop S so that downward pressure on the cap is not necessary as the cap is being refitted onto the radiator neck.

The ends of the band 11 are swingably mounted on pivot pins 14 and 15 which are affixed in side-by-side relation on a rigid swingable link 16 which is in the form of a channel-shaped bar with the pivot pins 14 and 15 protruding transversely downwardly from the bottom of the bar for attachment to the ends of the band 11.

The channel-shaped bar 16 has an open side 16.1 which faces inwardly toward the band 11, and has an outer or bottom wall 16.2 facing outwardly away from the band 11. The channelshaped bar extends longitudinally and in one piece well beyond the pivot pins 14 and 15 to define an extension or frame to which an upright rigid handle or gripper lug 17 is affixed as by welding. The gripper lug 17 is preferably formed of cylindrical and tubular steel and may be provided with a grip or cover 18 tightly affixed as by friction and preferably formed of a soft and resilient plastic material such as polyethylene. The lower end 17.1 of the handle or gripper lug 17 lies flush with the lower surface 19 of the bar 16 to cumulatively define a downwardly oriented pressure face to confront the top surface of the radiator cap C in the manner indicated in FIG. 3 for applying downward pressure on the radiator cap as the cap is to be removed from the radiator neck N. It will be seen that the lower end face 17.1 of the handle or gripper lug lies closely adjacent the upper edge 11.1 of the band so that the handle can swing across the band into and out of confronting relation with the top face of the radiator cap.

The channel-shaped link or bar 16 has a pair of rigid ears 20 and 21 affixed to and formed integrally of the bottom wall 16.2 of the bar, and the ears 20 and 21 protrude outwardly away from the bar and in a direction opposite to that of the band 11 so as to confront each other. The ears 20 and 21 will embrace the opposite sides of a radiator cap B of a slightly different configuration than cap C, and being provided with radially projecting lugs G against which the ears 20 and 21 bear in order to turn the cap B for removing and applying this cap.

In operation, the tool 10 is applied to the radiator cap with the band 11 embracing the cap periphery, substantially as illustrated in FIGS. 1 and 2. In this position, the loop in the band 11 is distended so that the band will easily slip downwardly over the periphery of the cap. If the cap is to be removed, it is to be turned counterclockwise as indicated by the arrow A in FIG. 1, whereupon the handle 17 and the link 16 are swung relative to both ends of the band 11 to the full line position illustrated in FIG. 3 wherein the handle 17 confronts the central portion of the cap C. When this position illustrated in FIG. 3 has been attained, the band will be in tightly gripping relation on the periphery of the cap and the bottom face 17.1 of the handle or gripping lug will bear downwardly on the top face of the cap, whereupon the cap may be manually revolved by rotating the handle and bar, simultaneously with the application of downward pressure in the direction of arrow D so that the flange F can pass by the stop lug S. It will be particularly noted that the greatest proportion of the tool 10 is confined within the periphery of the cap C, and at only isolated locations does any portion of the tool protrude outwardly beyond the periphery of the cap. Accordingly, this tool 10 can be conveniently used although there may be other physical obstructions immediately adjacent the cap at various portions of its periphery.

When the cap has been released from the neck of the radiator, the resilience in the band 11 contributes materially to the subsequent distension of the loop in the band for releasing the cap and swinging the link 16 and handle 17 back to the rest position illustrated in FIG. 1, whereupon the cap and tool can be readily separated.

When the cap C is to be returned onto the neck, it will be turned in a clockwise direction by swinging the handle and link to the dotted line position P illustrated in FIG. 3. In the event that the radiator R is supplied with a cap having the shape of cap B in FIGS. 4 and 6, the channel-shaped bar 16 is laid across the top of the cap with the depending ears 20 and 21 bearing against the lugs G. In this situation, downward pressure can be supplied through the handle 17 so as to depress the cap, making it possible for the cap to turn and release from the radiator neck.

It will be seen that I have provided a new and improved tool to embrace the periphery of a radiator cap and simultaneously apply downward pressure on the cap so that it can be permitted to turn with respect to a radiator neck. Turning is effected either by the gripping band 11 or by the depending rigid ears. The handle is swung, when the band grips the periphery of the cap, into confronting relation with the top face of the radiator cap so that downward pressure can be applied directly from the upstanding handle or gripping lug to the top face of the cap. The handle and link may be swung in the opposite direction to tighten the band onto the cap periphery for turning the cap in the opposite direction for reapplying the cap to the radiator.

What is claimed is:

1. A radiator cap gripping and turning tool comprising, a stiff but flexible band formed in a loop to embrace the periphery of such a radiator cap, the band having opposite ends adjacent each other, a rigid swingable link interposed between the ends of the band and having pivotal connections to both ends of the band, the link being swingable relative to the ends of the band to constrict the loop for gripping and turning the radiator cap, and a rigid handle on the link and swingable therewith in opposite directions between a rest position wherein the band is distended to loosely embrace the radiator cap and a gripping position wherein the loop is constricted onto the cap, the handle having a pressure-applying portion located adjacent the center of the loop while in said gripping position for applying downward pressure on a central portion of the cap while the band grips the periphery of the cap and turns the cap.

2. A radiator cap gripping and turning tool comprising, a stiff but flexible band formed in a loop to embrace the periphery of such a radiator cap, the band having opposite ends adjacent each other, a rigid swingable link interposed between the ends of the band and having pivotal connections to both ends of the band, the link being swingable in either direction relative to both ends of the band to constrict the loop in response to swinging of the link in either direction for gripping and turning the radiator cap, and a rigid handle on the link and swingable therewith in opposite directions from a rest position wherein the band is distended to loosely embrace the radiator cap and to first and second gripping positions wherein the loop is constricted onto the cap, the handle having a pressure-applying portion located adjacent the center of the loop while in said first gripping position for applying downward pressure on a central portion of the cap while the band grips the periphery of the cap and turns the cap, said portion of the handle being located eccentrically of the center of the loop while the handle is in said second gripping position for readily applying significant torque for turning the cap.

3. The gripping and turning tool according to claim 1 and the handle including an upstanding gripper lug to be manually manipulated and for applying downward pressure to the cap.

4. The gripping and turning tool according to claim 3 and said gripper lug being located within the periphery of the loop of the band when the handle is in said gripping position.

5. The gripping and turning tool according to claim 1 and the link and handle being formed integrally of each other and formed in an elongate rigid bar.

6. The gripping and turning tool according to claim 1 and said band having a top edge, the handle being disposed entirely above said edge, there being pivot pins protruding downwardly from the link to the ends of the band, and the top edge of the band and the pressure-applying portion of the handle lying in adjoining planes to facilitate swinging of the pressure-applying portion into bearing relation with the central portion of the cap as the band is constricted onto the periphery of the cap.

7. A radiator cap gripping and turning tool comprising, a stiff but flexible band formed in a loop to embrace the periphery of such a radiator cap, the band having opposite ends adjacent each other and an upper edge to lie nearly flush with the top face of the radiator cap, a rigid swingable link interposed between the ends of the band and having pivotal connections to both ends of the band, the link being swingable in either direction relative to both ends of the band to constrict the loop as the link is swung in either direction for gripping and turning the radiator cap, and a handle rigidly connected to the link and swingable therewith in opposite directions, the handle having a downwardly oriented pressure face swingable across the upper edge of the band and in closely spaced relation therewith whereby the handle is swingable from a rest position wherein the band is distended to loosely embrace the radiator cap to first and second gripping positions wherein the loop is constricted onto the cap, the pressure face of the handle being located adjacent the center of the loop while the handle is in said first gripping position to confront a central portion of the cap for applying downward pressure onto the cap as the loop grips the periphery of the cap and turns the cap in a first direction, and said handle being located in outwardly spaced relation from the looped band while in said second gripping position for turning the loop and cap in a second direction opposite to said first direction.

8. The gripping and turning tool according to claim 7 and the handle including an elongate bar having inner and outer ends, the inner end being formed integrally with the link and the outer end of the bar having an upstanding grip thereon to be manually gripped.

9. The gripping and turning tool according to claim 7 and the handle including a pair of spaced ears protruding therefrom and in a direction transverse to the axis of the band loop and away therefrom.

10. A radiator cap gripping and turning tool comprising, a stiff but resiliently flexible metal band formed in a loop to embrace the periphery of such a radiator cap, the band having opposite ends adjacent each other, each of the ends of the band having a permanent bight formed therein, a rigid channel-shaped bar with one end overlying the ends of the band to define a swingable link having a pair of downwardly projecting pivot pins in closely spaced relation to each other and protruding through said bights at the ends of the bands whereby to provide pivotal connections to both ends of the bands facilitating swinging of the bar and link in either direction relative to both of the ends of the band to distend and constrict the loop for gripping and turning the radiator cap, said channel-shaped bar having an open side facing inwardly of the loop of the band and having a closed side wall facing oppositely of said open side and outwardly of the periphery of the band loop, a rigid handle to be manually gripped and being affixed to said channel-shaped bar and swingable therewith in opposite directions, said handle protruding upwardly from said bar and from the band and having a bottom end face swingable with the channel-shaped bar across the upper edge of the band to a location adjacent the center of the loop for engaging and applying downward pressure on the cap as the cap is turned under influence of the gripping band and manual force exerted thereto, and a pair of rigid gripping ears affixed on and protruding transversely of the closed side wall of said channel-shaped bar and extending outwardly therefrom in a direction away from the open side of the channel-shaped bar, the handle being disposed adjacent said ears facilitating application of downward pressure through the channel-shaped bar onto a radiator cap with radially protruding lugs against which said ears bear for revolving the cap.

* * * * *